US005870804A

United States Patent [19]

Wylin

[11] Patent Number: 5,870,804

[45] Date of Patent: Feb. 16, 1999

[54] APPARATUS FOR CLAMPING A CYLINDRICAL WORKPIECE

[75] Inventor: James P. Wylin, Waterford, Mich.

[73] Assignee: Chrysler Corporation, Auburn Hills, Mich.

[21] Appl. No.: 922,253

[22] Filed: Sep. 2, 1997

[51] Int. Cl.[6] ..... A44B 21/00; B25B 1/00

[52] U.S. Cl. ..... 24/279; 24/514; 24/522

[58] Field of Search ..... 24/279, 278, 514, 24/522, 525, 569, 573.1, 573.5; 269/6, 221, 223; 248/316.5

[56] References Cited

U.S. PATENT DOCUMENTS

| | | | |
|---|---|---|---|
| 774,211 | 11/1904 | Totten | 24/522 |
| 951,509 | 3/1910 | Mintel | 24/279 |
| 2,305,854 | 12/1942 | English | 24/514 |
| 2,368,929 | 2/1945 | King | 24/279 |
| 3,736,629 | 6/1973 | Blake | 24/514 |
| 4,619,447 | 10/1986 | Blake | 269/221 |
| 4,799,639 | 1/1989 | Riley | 24/522 |

*Primary Examiner*—Victor N. Sakran
*Attorney, Agent, or Firm*—Thomas G. Pasternak

[57] ABSTRACT

An apparatus for clamping a generally cylindrical workpiece includes a band clamp and a clamp compressor. The band clamp is generally C-shaped and includes first and second ends. A sleeve is attached to the first end and receives a threaded shaft of a bolt. A head of the bolt is retained by the second end of the clamp end. A nut engages the threaded shaft of the bolt. The clamp compressor includes a main body portion and a locating portion extending from the main body portion which is adapted to releasably engage the first end of the band clamp. The locating portion is further operative to establish a fixed vertical position of the clamp compressor relative to the band clamp. The clamp compressor further includes a drive element interconnected to the main body portion which is adapted to releasably engage the second end of the band clamp. The drive element is adjustable so as to urge the first and second ends of the band clamp together when rotated in a first direction.

10 Claims, 1 Drawing Sheet

APPARATUS FOR CLAMPING A CYLINDRICAL WORKPIECE

BACKGROUND OF THE INVENTION

1. Technical Field

The present invention generally relates to the field of workpiece clamping. More particularly, the present invention relates an apparatus for clamping a cylindrical workpiece which includes a band clamp and a clamp compressor.

2. Discussion

The prior art teaches numerous devices for joining two or more workpieces. Where the two workpieces to be joined are generally cylindrical, a band clamp is often employed. For example, it is known to utilize a band clamp to join the catalyst and manifold components of a motor vehicle exhaust system.

While many known devices, including conventional band clamps, have proven to be acceptable for their intended applications, all are associated with disadvantages. Most significantly insofar as the present invention is concerned, known clamps often require two-handed operation, which is not convenient, and are difficult to operate when utilized in confined spaces. For example, when an exhaust system is operatively positioned in a motor vehicle, installation and removal of the band clamp which secures the catalyst and manifold components requires two persons. One person typically aligns the components and the other person compresses the band clamp with vice grips or the like and threads a locking nut of the band clamp into place.

Thus, a need exists for an apparatus for joining a pair of cylindrical workpieces which is easier to use within confined spaces by a single person.

SUMMARY OF THE INVENTION

In one form, the present invention comprises an apparatus for compressing a band clamp, the band clamp including first and second ends. The apparatus includes a main body portion and a locating portion extending from the main body portion. The locating portion is adapted to releasably engage the first end of the band clamp and establish a vertically fixed location of the apparatus relative to the band clamp. The apparatus further includes a drive element interconnected to the main body portion. The drive element is adapted to releasably engage the second end of the band clamp. The drive element is adjustable to urge the first and second ends of the band clamp together.

Benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 1:
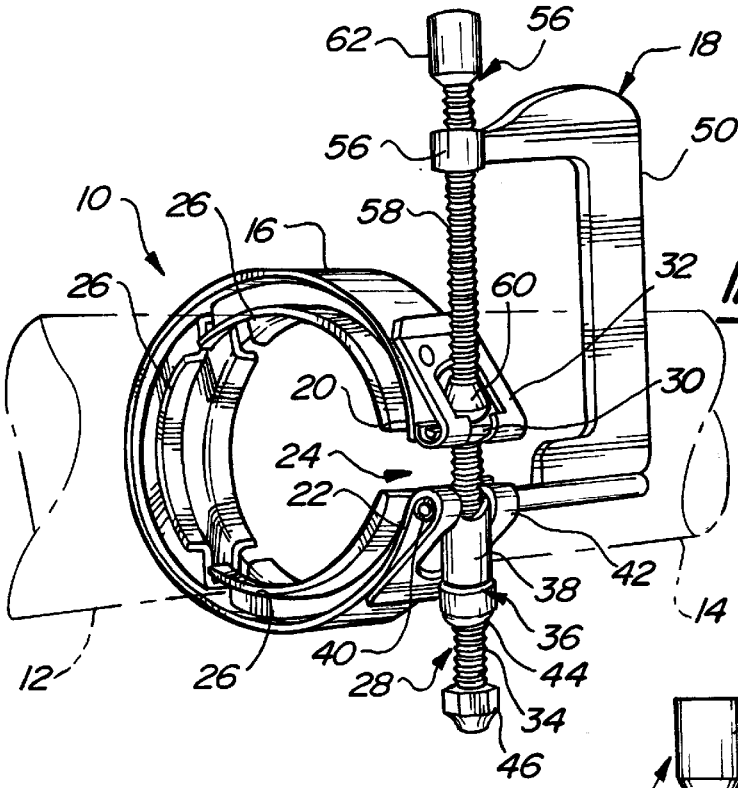
FIG. 1 is a perspective view of an apparatus of for clamping a workpiece constructed in accordance with the teachings of the present invention shown operatively associated with a pair of cylindrical workpieces.

Turning first to the environmental view of FIG. 1, an apparatus for clamping a pair of generally cylindrical workpieces constructed in accordance with the teachings of the preferred embodiment of the present invention is identified with reference numeral 10. The apparatus 10 is shown operatively associated with a pair of generally cylindrical workpieces 12 and 14. In one exemplary application, the cylindrical workpieces 12 and 14 are portions of the catalyst and manifold components of a motor vehicle exhaust system (not otherwise illustrated). However, it will become apparent to those skilled in the art that the apparatus 10 of the present invention may be employed for numerous other applications.

With continued reference to FIG. 1, the apparatus 10 of the present invention is shown to generally include a band clamp 16 and a clamp compressor 18. The band clamp 16 is conventional in construction and need not be described in great detail. However, a brief understanding of the construction and operation of the band clamp 16 is warranted in order to appreciate the advantages achieved through its cooperative use with the clamp compressor 18.

The band clamp 16 is shown to be generally C-shaped, having a first end 20 and a second end 22 spaced apart by a gap 24. The band clamp 16 includes a plurality of arcuate segments 26 conventionally configured to retain a flange (not shown) formed at the ends of each of the generally cylindrical workpieces 12 and 14.

A threaded fastener 28 is conventionally used to draw the first and second ends 20 and 22 of the band clamp 16 together and thereby clamp the pair of workpieces 12 and 14. The threaded fastener 28 includes a head 30 retained within a loop portion 32 positioned adjacent the first end 20. The threaded fastener 28 further includes a threaded shaft 34 which passes through a sleeve 36. The sleeve 36 is generally T-shaped, having a first portion 38 adapted to align along the axis of the threaded fastener 28, and a second portion 40 retained within a loop 42 formed at the second end 22 of the band clamp 16. The second portion 40 is disposed generally perpendicular to the first portion 38.

In conventional use, the band clamp 16 is sufficiently compressed so that the threaded portion 34 of the threaded fastener 28 extends from a lower end 44 of the sleeve 36 and may be engaged with a nut 46. Tightening of the nut 46 serves to further draw together the first and second ends 20 and 22 of the band clamp 16. However, in certain applications it may be necessary to limit the length of the threaded fastener 28. As a result, a significant amount of force must be applied to sufficiently compress the first and second ends 20 and 22 of the band clamp 16 together before threading of the nut 46 on the threaded portion 34 may be initiated. This action is made additionally difficult where the work space is confined and conventional tools such as vice grips and the like may not be employed to compress the first and second ends 20 and 22 of the band clamp 16 together. As will become more apparent below, the clamp compressor 18 of the present invention is intended to overcome these difficulties.

Figure 2:
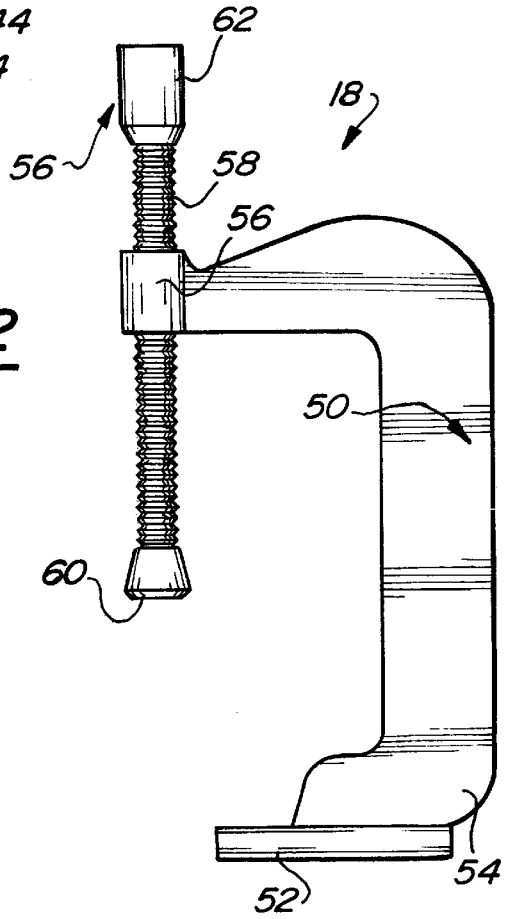
FIG. 2 is a enlarged side view of the clamp compressor of FIG. 1.
Figure 3:
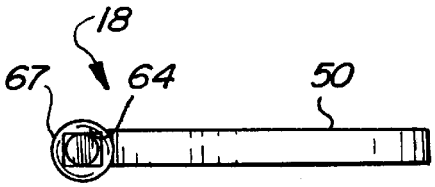
FIG. 3 is a enlarged top view of the clamp compressor of FIG. 1.

With continued reference to FIG. 1 and additional reference to FIGS. 2 and 3, the clamp compressor 18 of the present invention will now be described. The clamp compressor 18 is shown to include a main body portion 50 having a generally C-shape. The clamp compressor 18 further includes a locating portion 52 extending from a lower end 54 of the main body portion 50. The locating portion 52 is generally cylindrical and is adapted to releasably engage the second end 22 of the band clamp 16. The locating portion 52 functions to establish a vertically fixed position of the clamp compressor 18 relative to the band clamp 16 (e.g. once the locating portion 52 engages the second end 22, it cannot inadvertently move up or down). Specifically, the locating portion 52 is adapted to engage the portion 40 of the sleeve 36 which is retained within the loop 42.

The clamp compressor 18 further includes a drive element 56 interconnected to the main body portion 50 and adapted to releasably engage the first ends 20 of the band clamp 16. The drive element 56 is downwardly adjustable so as to urge the first end 20 and the second end 22 of the band clamp 16 together. In the embodiment illustrated, the drive element 56 includes a threaded rod 58 engaged with an internally threaded aperture (not shown) formed in an upper end of the main body portion 50. At its lower end, the threaded rod 58 is attached to a foot 60 for engaging the head 32 of the threaded fastener 28. At its upper end, the drive element 56 includes a head 62 formed to include a generally rectangular aperture 64 for receiving a socket drive (not shown). When rotated in a first direction (i.e. clockwise), the foot 60 of the drive element 56 is downwardly displaced. Conversely, when rotated in a second direction (i.e. counterclockwise) the drive element 56 is upwardly displaced.

In use, an operator aligns the pair of generally cylindrical workpieces 12 and 14 and surrounds their adjacent ends (not specifically shown) with the band clamp 16. The cylindrical portion 52 of the clamp compressor 18 engages the portion 40 of the sleeve 36 and the foot 60 engages the head 30 of the threaded fastener 38. A socket drive (not shown) engages the head 62 of the drive element 56. Through clockwise rotation, the foot 60 is driven downward, thereby compressing the first and second ends 20 and 22 of the band clamp 16 together. This action causes the threaded portion 34 of the threaded fastener 28 to extend from the end 44 of the sleeve 36.

While the above description constitutes the preferred embodiment of the invention, it will be appreciated that the invention is susceptible to modification, variation, and change without departing from the proper scope or fair meaning of the accompanying claims.

We claim:

1. An apparatus for clamping a cylindrical workpiece, the apparatus comprising:

a band clamp being generally C-shaped having a first end and a second end;

a sleeve attached to the first end;

a bolt having a head retained by the band clamp at the second end, the bolt having a threaded shaft passing through the sleeve;

a nut engaging the threaded shaft of the bolt; and a compressor member for compressing the first and second ends of the band clamp together to a clamped position, the compressor member including:

a main body portion;

a locating portion extending from said main body portion and adapted to releasably engage the first end of the band clamp and establish a vertically fixed position of the apparatus relative to the band clamp; and a drive element interconnected to the main body portion and adapted to releasably engage the second end of the band clamp, the drive element being adjustable to urge the first and second ends together.

2. The apparatus for clamping a cylindrical workpiece of claim 1, wherein the drive element includes a shaft threadably engaged with the main body portion.

3. The apparatus for clamping a cylindrical workpiece of claim claim 2, wherein the drive element includes a head formed to include a generally wherein the rectangular aperture adapted to receive a socket driver.

4. The apparatus for clamping a cylindrical workpiece of claim 1, wherein the main body portion is generally C-shaped.

5. The apparatus for clamping a cylindrical workpiece of claim 1, wherein the locating portion is generally cylindrical.

6. An apparatus for clamping a workpiece, the apparatus comprising:

a clamp having a first end and a second end;

a sleeve attached to the first end;

a bolt having a head retained by the clamp at the second end, the bolt having a threaded shaft passing through the sleeve;

a nut engaging the threaded shaft of the bolt; and a compressor member for compressing the first and second ends of the clamp together to a clamped position, the compressor member including:

a main body portion;

a locating portion extending from said main body portion and adapted to releasably engage the first end of the clamp and establish a vertically fixed position of the apparatus relative to the clamp; and a drive element interconnected to the main body portion and adapted to releasably engage the second end of the clamp, the drive element being adjustable to urge the first and second ends together.

7. The apparatus for clamping a workpiece of claim 6, wherein the drive element includes a shaft threadably engaged with the main body portion.

8. The apparatus for clamping a workpiece of claim 7, wherein the drive element includes a head formed to include a generally rectangular aperture adapted to receive a socket driver.

9. The apparatus for clamping a workpiece of claim 6, wherein the main body portion is generally C-shaped.

10. The apparatus for clamping a workpiece of claim 6, wherein the locating portion is generally cylindrical.

* * * * *